US011690493B2

(12) United States Patent
Weis et al.

(10) Patent No.: US 11,690,493 B2
(45) Date of Patent: Jul. 4, 2023

(54) CLEANING ROBOT AND CLEANING SYSTEM

(71) Applicant: CARL FREUDENBERG KG, Weinheim (DE)

(72) Inventors: Norbert Weis, Weinheim (DE); Marc Heiland, Worms (DE); Christian Stenglein, Frankfurt am Main (DE)

(73) Assignee: CARL FREUDENBERG KG, Weinheim (DE)

( * ) Notice: Subject to any disclaimer, the term of this patent is extended or adjusted under 35 U.S.C. 154(b) by 0 days.

(21) Appl. No.: 17/778,867

(22) PCT Filed: Jul. 23, 2020

(86) PCT No.: PCT/EP2020/070771
§ 371 (c)(1),
(2) Date: May 23, 2022

(87) PCT Pub. No.: WO2021/104689
PCT Pub. Date: Jun. 3, 2021

(65) Prior Publication Data

US 2022/0409001 A1 Dec. 29, 2022

(30) Foreign Application Priority Data

Nov. 28, 2019 (DE) ..... 10 2019 132 312.6

(51) Int. Cl.

| | |
|---|---|
| ***A47L 11/40*** | (2006.01) |
| ***A47L 11/10*** | (2006.01) |
| ***A47L 11/28*** | (2006.01) |

(52) U.S. Cl.
CPC ..... *A47L 11/4036* (2013.01); *A47L 11/10* (2013.01); *A47L 11/28* (2013.01); *A47L 11/4002* (2013.01); *A47L 11/4091* (2013.01); *A47L 2201/02* (2013.01)

(58) Field of Classification Search
CPC .. A47L 11/10; A47L 11/4036; A47L 2201/02; A47L 2201/028
See application file for complete search history.

(56) References Cited

U.S. PATENT DOCUMENTS

| | | | | |
|---|---|---|---|---|
| 9,265,396 | B1 * | 2/2016 | Lu | A47L 11/4066 |
| 2005/0241086 | A1 | 11/2005 | Damrath | |
| 2011/0202175 | A1 * | 8/2011 | Romanov | A47L 11/4036 700/250 |
| 2014/0373302 | A1 | 12/2014 | Hsu | |

(Continued)

FOREIGN PATENT DOCUMENTS

| | | | |
|---|---|---|---|
| CN | 204813712 | U | 12/2015 |
| CN | 106889955 | A * | 6/2017 |

(Continued)

*Primary Examiner* — Randall E Chin
(74) *Attorney, Agent, or Firm* — Leydig, Voit & Mayer, Ltd.

(57) ABSTRACT

A cleaning robot including: a main body; a drive device; and a cleaning device equipped for wet-cleaning floors to be cleaned, wherein: the main body, on the side facing the floor to be cleaned, is assigned a receptacle unit, a first mop pad configured for wet-cleaning is fastened to the receptacle unit, and the cleaning robot is configured to autonomously exchange the first mop pad fastened to the receptacle unit for a second mop pad.

16 Claims, 9 Drawing Sheets

(56) References Cited

U.S. PATENT DOCUMENTS

| | | | | |
|---|---|---|---|---|
| 2015/0182089 | A1 | 7/2015 | Jeong | |
| 2017/0049288 | A1* | 2/2017 | Knutson | A47L 11/4083 |
| 2019/0142237 | A1 | 5/2019 | Isenberg | |
| 2020/0139561 | A1* | 5/2020 | Kim | B25J 9/0003 |

FOREIGN PATENT DOCUMENTS

| | | | |
|---|---|---|---|
| CN | 206880637 | U | 1/2018 |
| CN | 110151065 | A | 8/2019 |
| CN | 209236042 | U | 8/2019 |
| DE | 10256089 | A1 | 6/2004 |
| DE | 202014102687 | U1 | 6/2014 |
| DE | 102018000083 | A1 | 7/2019 |
| EP | 3069644 | A1 | 9/2016 |
| EP | 3482669 | A1 | 5/2019 |
| EP | 3494855 | A1 | 6/2019 |
| KR | 1020150078093 | A | 7/2015 |
| WO | WO 2020096246 | A1 | 5/2020 |

* cited by examiner

CLEANING ROBOT AND CLEANING SYSTEM

CROSS REFERENCE TO PRIOR APPLICATIONS

This application is a U.S. National Phase application under 35 U.S.C. § 371 of International Application No. PCT/EP2020/070771, filed on Jul. 23, 2020, and claims benefit to German Patent Application No. DE 10 2019 132 312.6, filed on Nov. 28, 2019. The International Application was published in German on Jun. 3, 2021 as WO 2021/104689 A1 under PCT Article 21(2).

FIELD

The invention relates to a cleaning robot, comprising a main body, a drive device and a cleaning device, wherein the cleaning device is equipped for the wet-cleaning of floors that are to be cleaned, wherein the main body is assigned a receptacle unit for a mop pad on the side facing the floor to be cleaned, wherein for the wet cleaning a mop pad is fastened to the receptacle unit. The invention further relates to a cleaning system comprising a cleaning robot and a base station.

BACKGROUND

Robots which are designed for wet cleaning are known, for example, from EP 3 482 669 A1. In the previously known cleaning robot, a cleaning element can be placed on a floor that is to be cleaned and can be removed again from the floor that is to be cleaned. The cleaning element is firmly connected to the cleaning robot. It is disadvantageous here that the areal performance of such a cleaning robot is limited, since dirt accumulates on the cleaning element and must be removed from time to time. It is, however, necessary to interrupt the cleaning work of the cleaning robot and to remove the dirt from the cleaning element manually.

SUMMARY

In an embodiment, the present invention provides a cleaning robot comprising: a main body; a drive device; and a cleaning device equipped for wet-cleaning floors to be cleaned, wherein: the main body, on the side facing the floor to be cleaned, is assigned a receptacle unit, a first mop pad configured for wet-cleaning is fastened to the receptacle unit, and the cleaning robot is configured to autonomously exchange the first mop pad fastened to the receptacle unit for a second mop pad.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
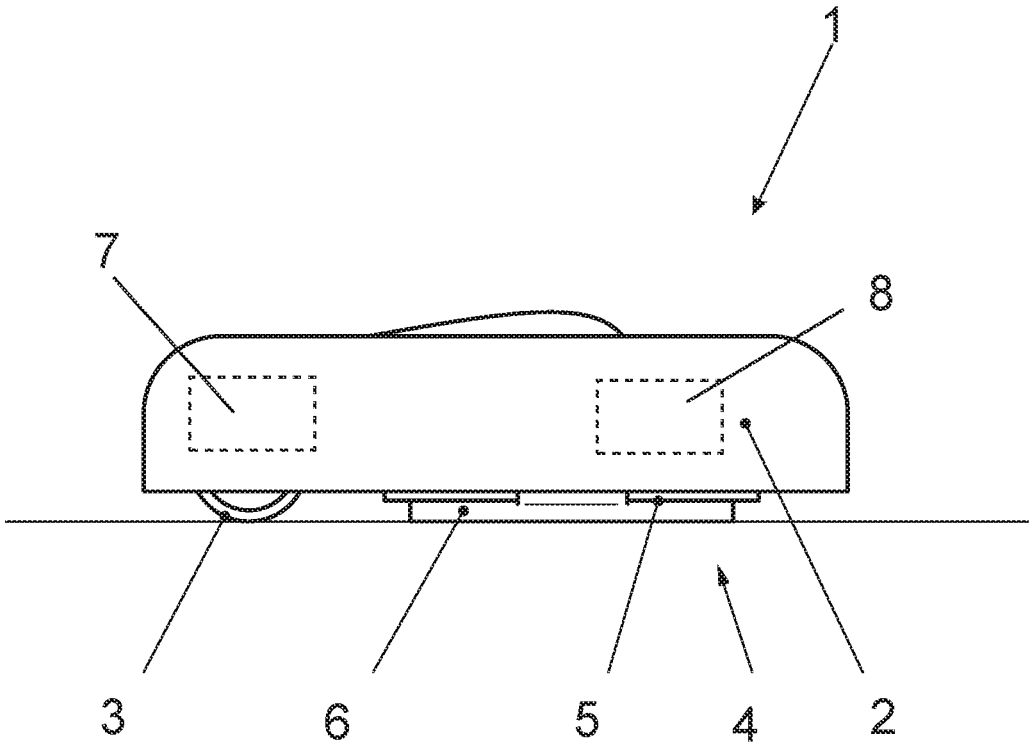
FIG. 1 illustrates a cleaning robot.

Embodiments of the present invention provide a cleaning robot for wet cleaning which has a greater areal performance.

In some embodiments, the cleaning robot is equipped to autonomously exchange the mop pad attached to the receptacle unit for another mop pad. In this case, the mop pad is detachably attached to the receptacle unit, wherein the cleaning robot is equipped to carry out the change of mop pad autonomously without the aid of an operator. If a larger area is to be cleaned, it is conceivable that the areal performance of a single mop pad will be inadequate. As a result, the cleaning robot can exchange a used mop pad for a new mop pad during cleaning work. As a result, it is possible for the cleaning robot to achieve a greater areal performance and, in particular, to be able to fully clean even larger areas.

A first storage unit for storing mop pads can be assigned to the main body. Here the first storage unit is equipped to hold a plurality of mop pads and to send them to the receptacle unit as required. For example, the first storage unit can be equipped to hold five unused mop pads.

The mop pads stored in the first storage unit can be provided with a cleaning agent. In an embodiment, the mop pads are pre-moistened and stored in the first storage unit ready prepared for cleaning. After being sent to the receptacle unit, the pre-moistened mop pads thus stored are immediately ready for wet cleaning.

A second storage unit for storing used mop pads can be assigned to the main body. If a used mop pad is exchanged for a new mop pad during cleaning work, a new mop pad will be removed from the first storage unit and the used mop pad sent to the second storage unit.

Alternatively, it is conceivable for a mop pad to be removed from the first storage unit, sent to the receptacle unit, and the used mop pad sent from the receptacle unit back to the first storage unit.

The mop pads can be reusable. Such mop pads are preferably made of a textile structure. The mop pads are preferably machine-washable so that hygienic cleaning of the mop pads in a washing machine is possible.

The mop pads can be designed as disposable articles. In this case, the disposable articles can take the form of single-use cloths. In particular, it is conceivable for the disposable articles that have been pre-moistened with a cleaning agent to be stored in a box. It is conceivable for the box to constitute a sales unit and for the box with the mop pads arranged therein to be purchasable by the user as a unit.

Furthermore, it is conceivable for the box to form the storage unit so that the box, with the mop pads stored therein, can be arranged directly in the main body of the cleaning robot. This results in a particularly simple handling.

Alternatively, it is conceivable for the mop pads to be made of a textile and thereby be reusable several times. In this case, it is particularly advantageous if the mop pads are machine-washable. In an embodiment, it is advantageous that the amount of waste is reduced.

A transport device can be assigned to the main body, which transport device transports mop pads from the storage unit to the receptacle unit and/or from the receptacle unit to the second storage unit. For this purpose, the transport device can have, for example, a gear arrangement or a belt drive or the like.

The mop pads are preferably held in a form-fitting manner on the receptacle unit. For this purpose, the mop pads can be provided with an arrangement of perforations on mutually opposite edges, for example in the form of a hole pattern. The openings engage with associated elevations in the receptacle unit, for example projections like gearwheels. As a result, the mop pad can be held securely on the receptacle unit. Furthermore, it is conceivable for the transport unit to engage with the form-fitting elements and to transport the mop pad from the first storage unit to the receptacle unit and/or from the receptacle unit to the second storage unit.

The mop pads can be held on the receptacle unit by means of a fastening means. The fastening means can consist, for example, of magnets which are assigned to the mop pad and to the receptacle unit. Furthermore, it is conceivable for the mop pad to be held on the receptacle unit by means of a hook-and-loop fastener.

If a mop pad fastened to the receptacle unit is to be released for removal, it is conceivable for the receptacle unit to be mounted movably beneath the main body and to retract into the main body for removal of the mop pad. In this case, the mop pad in the receptacle unit is removed and can be replaced.

The mop pad can be equipped with a reinforcement. This can be formed from the textile strips or plastic strips assigned to the edges of the mop pad. Reinforcement results in a dimensionally stable mop pad.

The cleaning system for solving the task comprises a cleaning robot as described above and a base station, wherein the base station is equipped to hold a first magazine of mop pads.

Base stations for cleaning robots are known, wherein in the case of known cleaning robots the base station is used for charging the rechargeable batteries of the electric drive of the cleaning robot. For this purpose, the cleaning robot can approach the base station autonomously.

In an embodiment according to the invention, the base station is in addition provided with a first magazine in which mop pads are held. If the cleaning robot approaches the base station, the cleaning robot will then be able to pick up one or more mop pads from the base station automatically. If the cleaning robot is equipped to hold only one mop pad, said mop pad will be sent directly to the receptacle unit. If the cleaning robot is equipped to hold a plurality of mop pads, they will be sent to the storage unit of the cleaning robot.

The base station can be provided with a second magazine for holding used mop pads. In this context, it is conceivable for the cleaning robot to be provided with only a single mop pad, which is located on the receptacle unit, wherein the cleaning robot approaches the base station to replace the mop pad. In this case, the mop pad can be sent directly from the receptacle unit to the second magazine. In an embodiment, the cleaning robot is equipped to send to the second magazine of the base station used mop pads temporarily stored in a second storage unit.

The base station can comprise a pre-treatment device for pre-treating the mop pads. In this context, it is particularly conceivable for the base station to be provided with a fresh-water connection and/or a waste-water connection. If the base station is provided with a pre-treatment device, the mop pads can be stored untreated in the first magazine, in other words dry. When the mop pads are sent to the cleaning robot, the mop pads are pre-treated via the pre-treatment device. However, the mop pads arranged in the first magazine can also be pre-treated. Here the mop pads are preferably provided with a suitable cleaning agent. It is conceivable here for a cleaning agent adapted to the upcoming cleaning task to be applied to the mop pad. For example, a cleaning agent suitable for natural stone or a cleaning agent suitable for wooden floors can be applied to the mop pad as required. Furthermore, it is conceivable for fragrances or care products to be applied to the mop pads.

The dispensing and selection of the cleaning agents or care products can be dependent on an automatic recognition of the upcoming cleaning task or of the floor to be cleaned or of a prespecified assignment of a floor area to be cleaned or of a room. For this purpose, the cleaning robot can be equipped with a device for space recognition. Furthermore, the cleaning robot can be equipped with a memory unit in which a predefined cleaning program for a prespecified space is stored. The cleaning program can specify the wiping duration, the amount of cleaning liquid to be applied, the contact pressure of the mop pad against the floor to be cleaned and/or the type of cleaning agent or care product.

It is also conceivable for the mop pad to be equipped with communication means for communication with the cleaning robot. Various, preferably electronically readable identifiers are conceivable as communication means. Such identifiers are, for example, QR codes, hole patterns, and radio transponders, such as RFID chips. In this case, it is conceivable for mop pads of different designs to be available to the cleaning robot in the storage unit or in the base station, and for the cleaning robot to select a mop pad that is prespecified by the cleaning program and intended for the upcoming cleaning task, wherein the mop pad is located by means of the communication means.

The pre-treatment device can be designed as a spraying device which sprays the mop pads with a cleaning agent and care product when they are removed from the magazine. However, it is also conceivable for the pretreatment device to be equipped to pre-treat all of the mop pads stored in the first magazine.

The base station can have a post-treatment device for the post-treatment of mop pads. The post-treatment device is in particular equipped to post-treat the used mop pads transferred from the cleaning robot into the second magazine. Post-treatment can comprise disinfection and/or drying. For disinfection, it is conceivable for the used mop pads to be exposed to UV light. The mop pads can be dried by means of air stream, for example by means of a blower.

Some embodiments of the cleaning robot according to the invention are explained in more detail below by reference to the figures. These show, in each case schematically:

FIG. 1 shows a cleaning robot 1 comprising a main body 2, a drive device 3 and a cleaning device 4. The cleaning robot 1 is equipped to move autonomously over a floor to be cleaned and to carry out cleaning work. For this purpose, the drive device 3 comprises wheels driven by an electric motor, wherein the electric motor is supplied with energy via a rechargeable battery. The drive device 3 further comprises a sensor device by means of which the cleaning robot 1 can navigate over the floor to be cleaned. The rechargeable battery is charged in a base station 13. The cleaning robot 1 is configured to move to the base station 13 autonomously.

The cleaning device 4 is equipped for the wet-cleaning of floors to be cleaned. For this purpose, a receptacle unit 5 for a mop pad 6 is assigned to the main body 2 on the side facing the floor to be cleaned. For wet-cleaning, a mop pad 6 is fastened to the receptacle unit 5. Here the cleaning robot 1 is equipped to automatically replace the mop pad 6 fastened to the receptacle unit 5 with another mop pad 6.

According to an advantageous embodiment of the cleaning robot 1, a first storage unit 7 for storing mop pads can be assigned to the main body 2. The first storage unit 7 is preferably integrated into the main body 2 so that a magazine of mop pads 6 is arranged in the first storage unit 7 within the main body 2. The mop pads 6 stored in the storage unit 7 can be pre-treated with a cleaning agent so that they are directly ready for use when they are sent to the receptacle unit 5. A second storage unit 8 for storing used mop pads 6 can be assigned to the main body 2. In an embodiment, the mop pads 6 are preferably designed to be reusable.

Alternatively, the mop pads 6 can be designed as disposable articles or single-use cloths.

Figure 2:
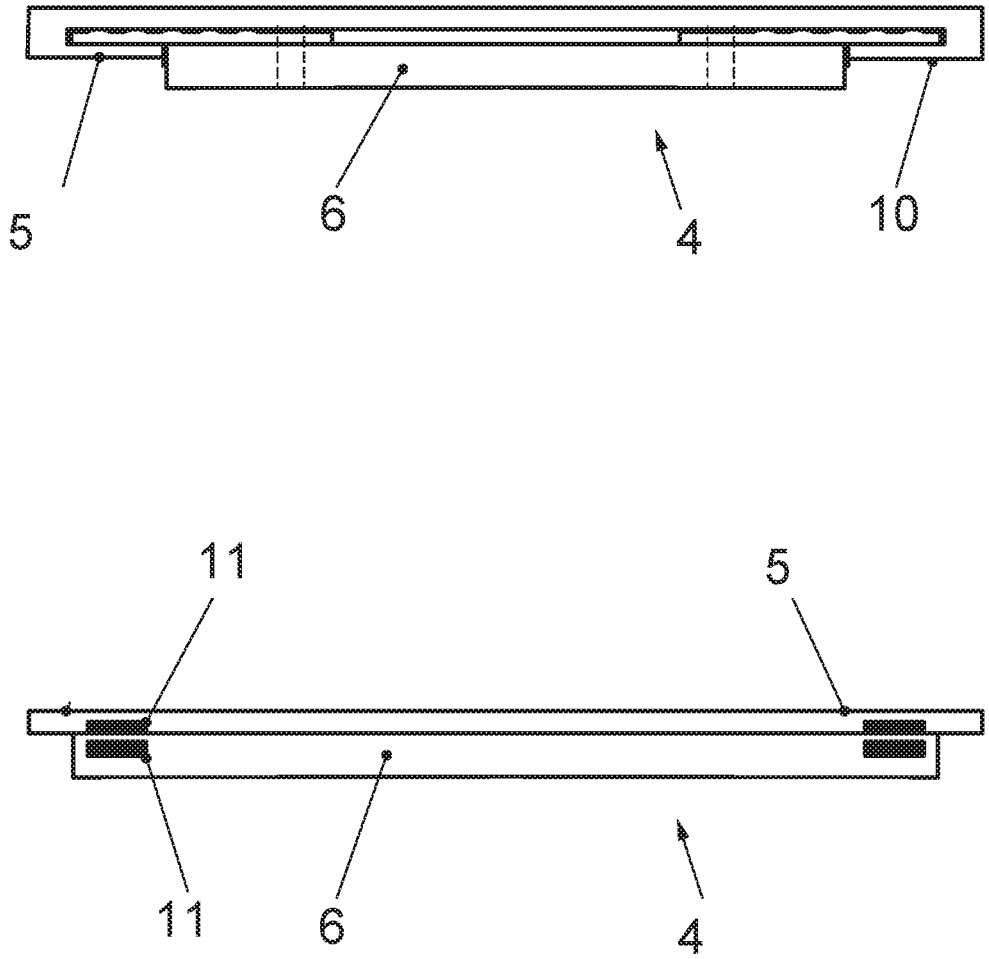
FIG. 2 illustrates in detail the receptacle unit of the cleaning robot.

FIG. 2 shows in detail the receptacle unit 5 of the cleaning robot 1 described in FIG. 1. A transport device 10 is assigned to the main body 2, which transport device transports mop pads 6 from the first storage unit 7 to the receptacle unit 5 and then from the receptacle unit 5 to the second storage unit 8. The mop pad 6 is held in a form-fitting manner on the receptacle unit 5 and held securely on the receptacle unit 5 via a fixing means 11 in the form of magnets.

Figure 3:
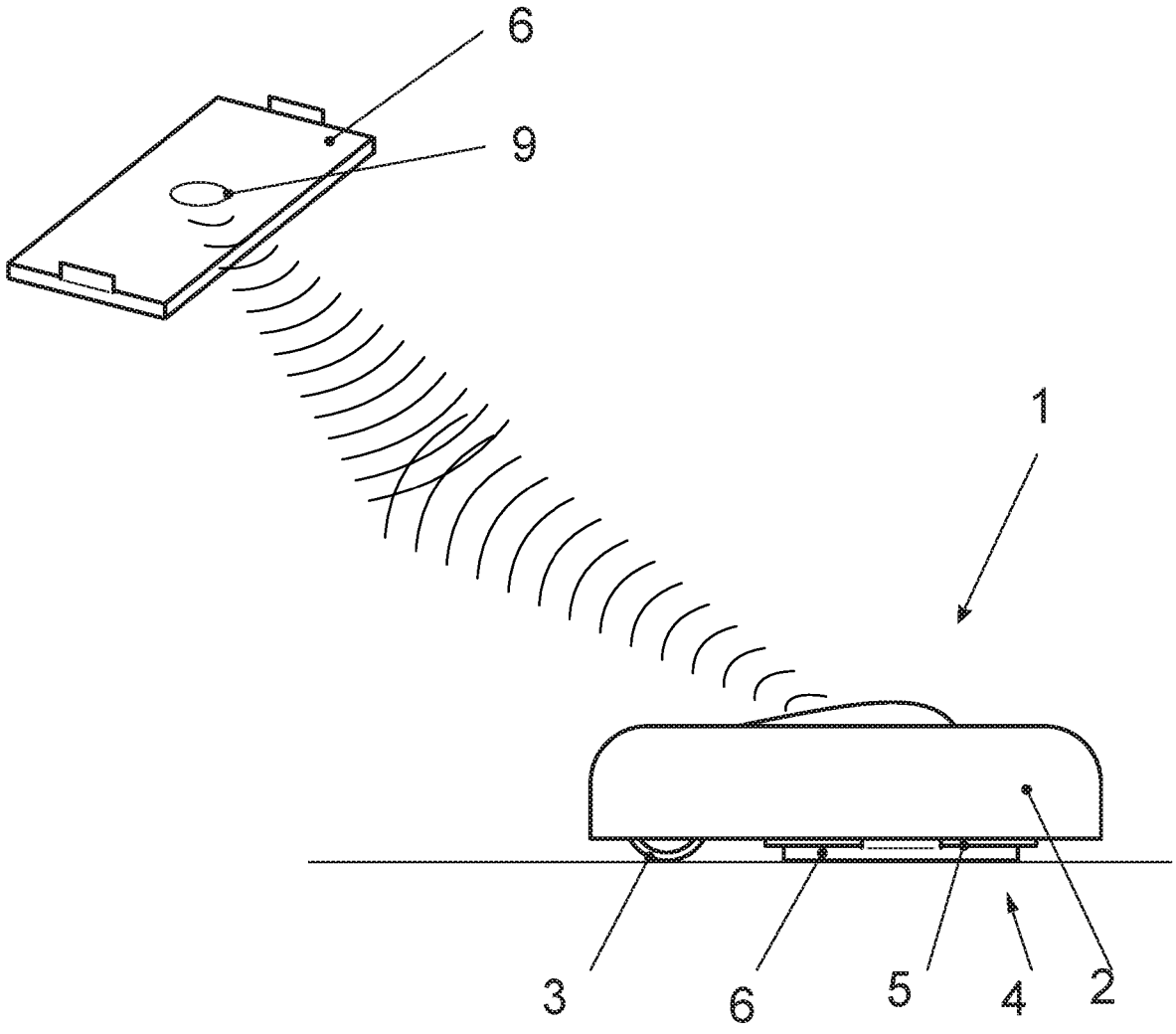
FIG. 3 illustrates a mop pad equipped with communication means.

FIG. 3 shows an embodiment of the cleaning robot 1 described in FIG. 1, wherein the mop pad 6 is equipped with communication means 9 for communication with the cleaning robot 1. In an embodiment, the cleaning robot 1 also comprises communication means 9 in order to be able to exchange data with the mop pad 6. The communication means 9 are equipped to communicate via near-field communication (NFC). For this purpose, an RFID chip can be integrated into the mop pad 6. The RFID chip can contain data which enable an unambiguous assignment of the mop pad 6. In this context, it is particularly conceivable for the number of cleaning cycles run through by the mop pad 6 to be detected and for the mop pad 6 to be located.

Figure 4:
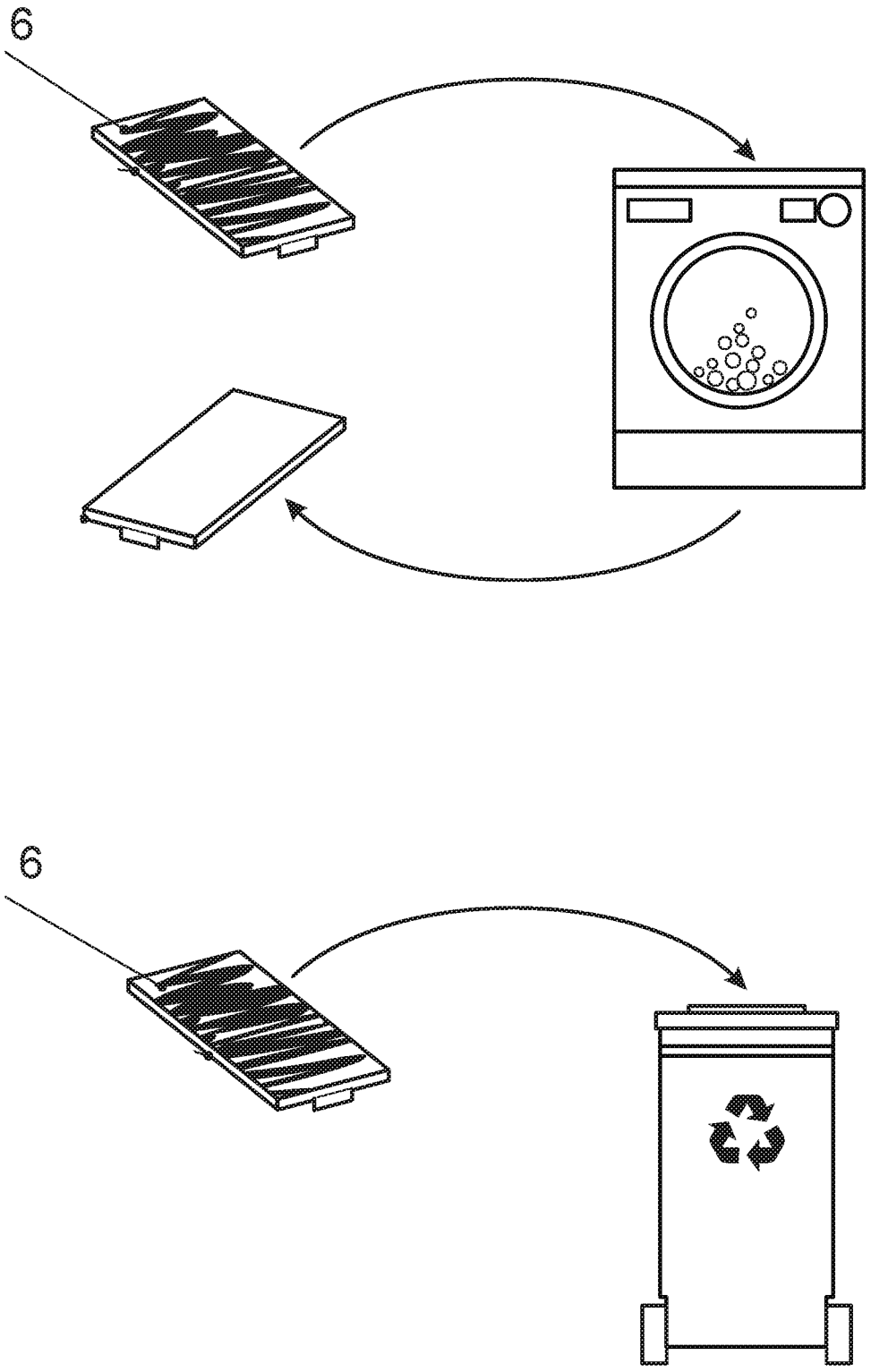
FIG. 4 illustrates various embodiments of mop pads.

FIG. 4 shows different embodiments of mop pads, wherein the mop pad 6 shown at the top is produced from a textile material and can be used multiple times. The mop pad 6 can be subjected to a machine washing for cleaning. The mop pad 6 shown below is designed as a disposable article or as a single-use cloth.

Figure 5:
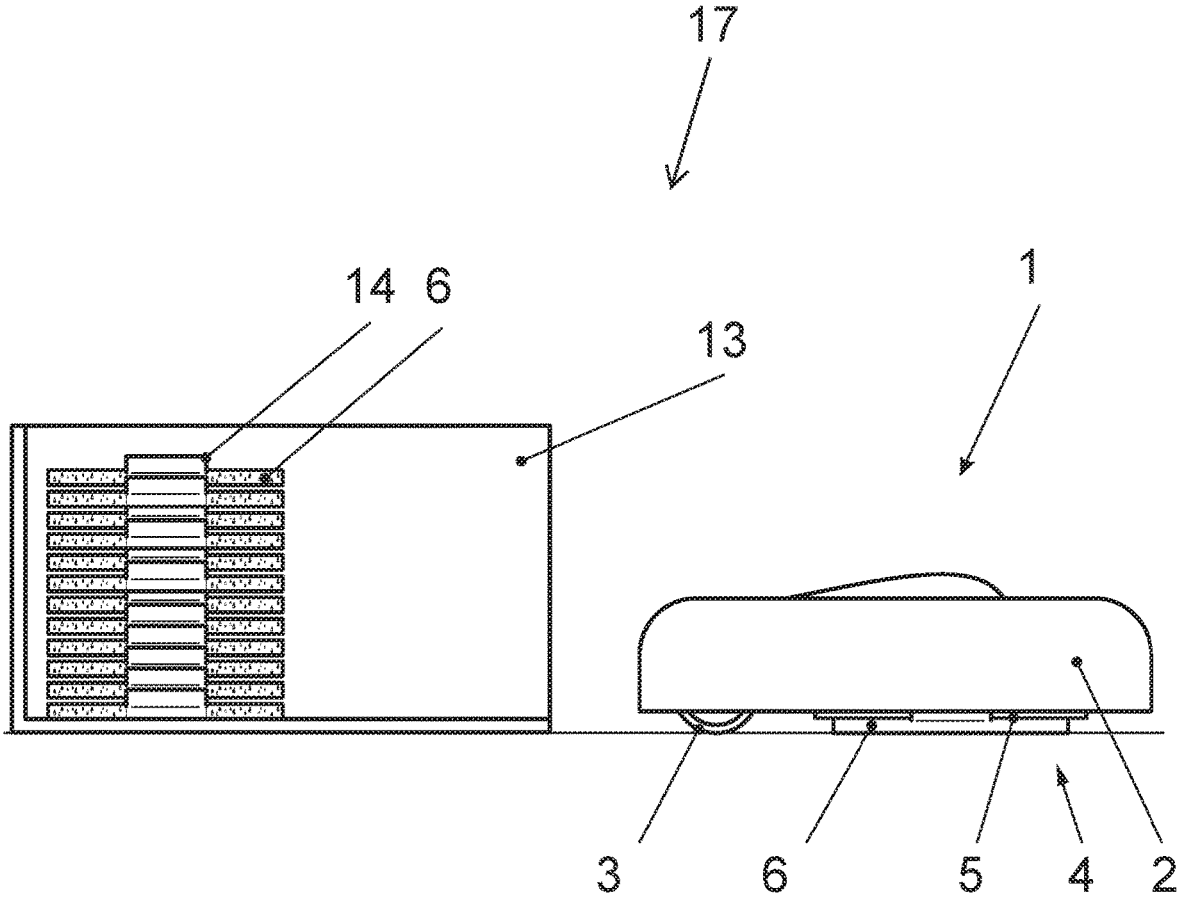
FIG. 5 illustrates a cleaning system with a first magazine.

FIG. 5 shows a cleaning system 17, comprising a cleaning robot 1 as described above, and a base station 13. The base station 13 is equipped to accommodate a first magazine 14 of mop pads 6. In an embodiment, the cleaning robot 1 is equipped to remove a mop pad 6 from the first magazine 14 and to send it to the receptacle unit 5. If the cleaning robot 1 has a storage unit 8, the cleaning robot 1 will also be able to remove a plurality of mop pads 6 from the first magazine 14.

Figure 6:
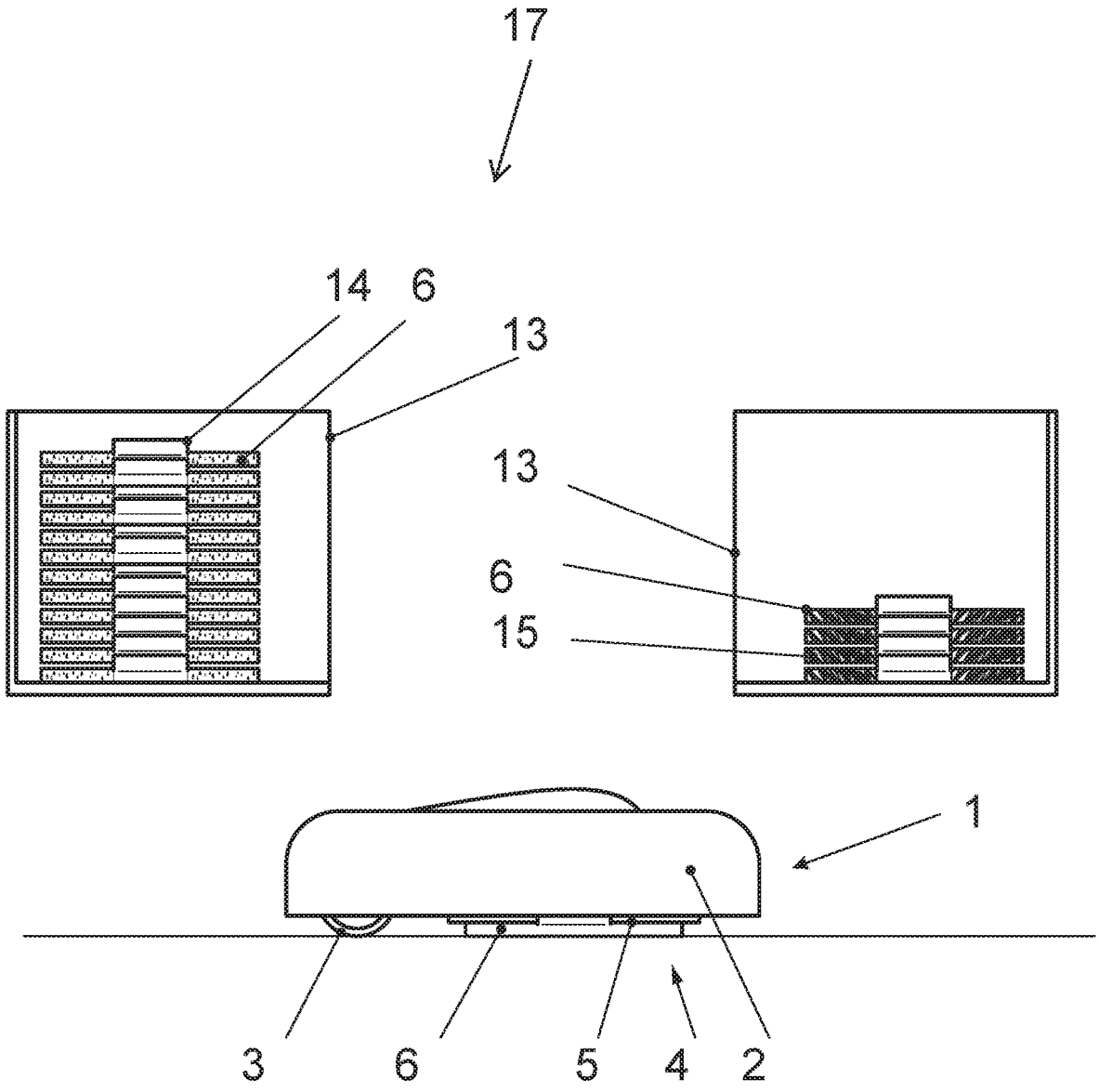
FIG. 6 illustrates a cleaning system with a first magazine and a second magazine.

FIG. 6 shows a further embodiment of the cleaning system 17 described in FIG. 5. In an embodiment, the base station 13 comprises a second magazine 15 for receiving used mop pads 6.

Figure 7:
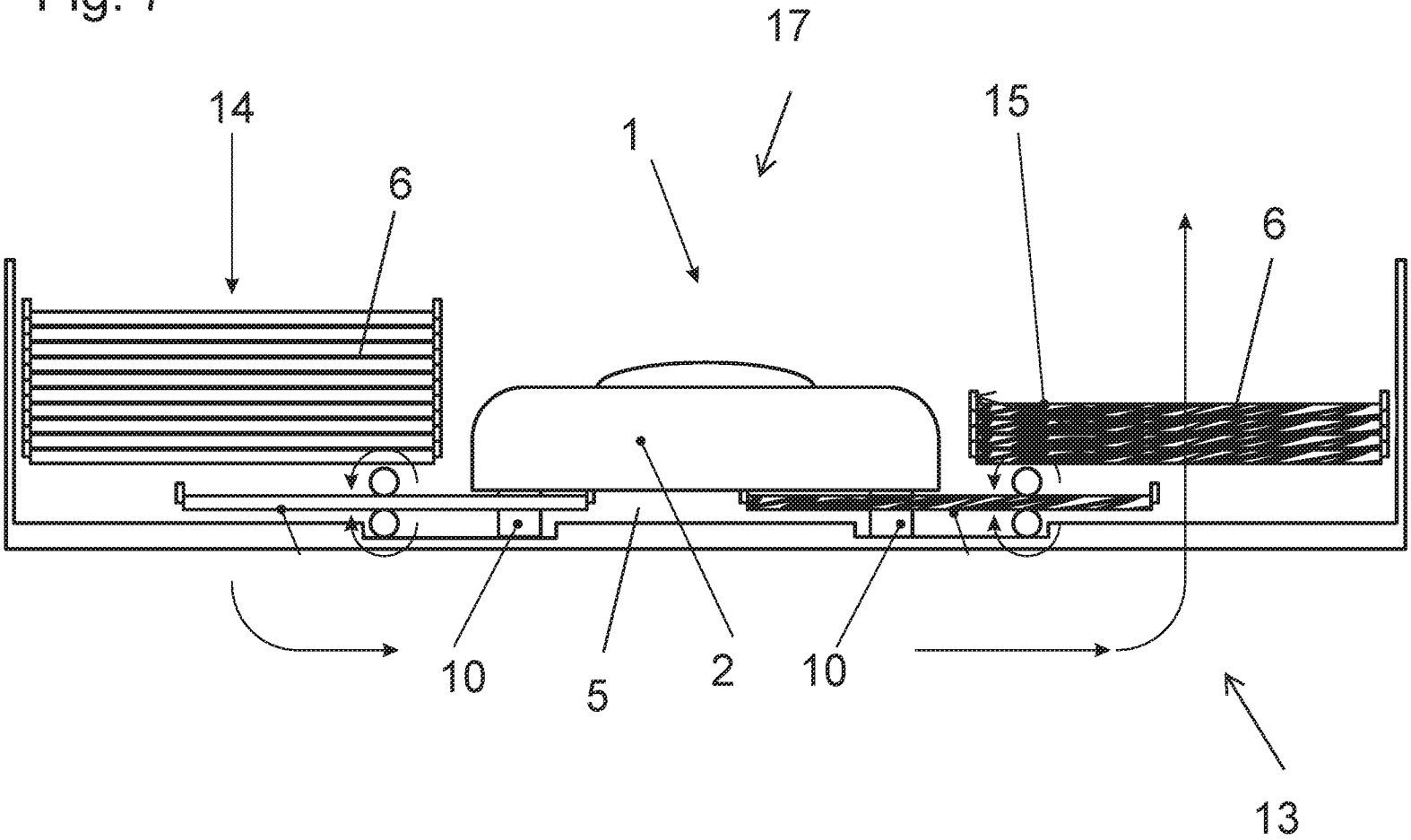
FIG. 7 illustrates a cleaning system with a transport device.

FIG. 7 shows the process of replacing mop pads 6, while the cleaning robot 1 is at the base station 13. During the replacement of mop pads 6, a charging process can take place at the same time, in which the rechargeable battery integrated in the main body 2 of the cleaning robot 1 is charged. If the cleaning robot 1 is at the base station 13, a used mop pad 6 can be transported by the receptacle unit 5 in the direction of the second magazine 15 via the transport device 10. A fresh mop pad 6 is then removed from the first magazine 14 and sent via the transport device 10 to the receptacle unit 5 where it is fastened to the receptacle unit 5 in a force-fitting and form-fitting manner by means of the fastening means 11.

In an embodiment, in which the cleaning robot 1 has a first storage unit 7 and a second storage unit 8, the used mop pads 6 received in the second storage unit 8 are sent to the second magazine 15, while a plurality of mop pads 6 is removed from the first magazine 14 and sent to the first storage unit 7.

Figure 8:
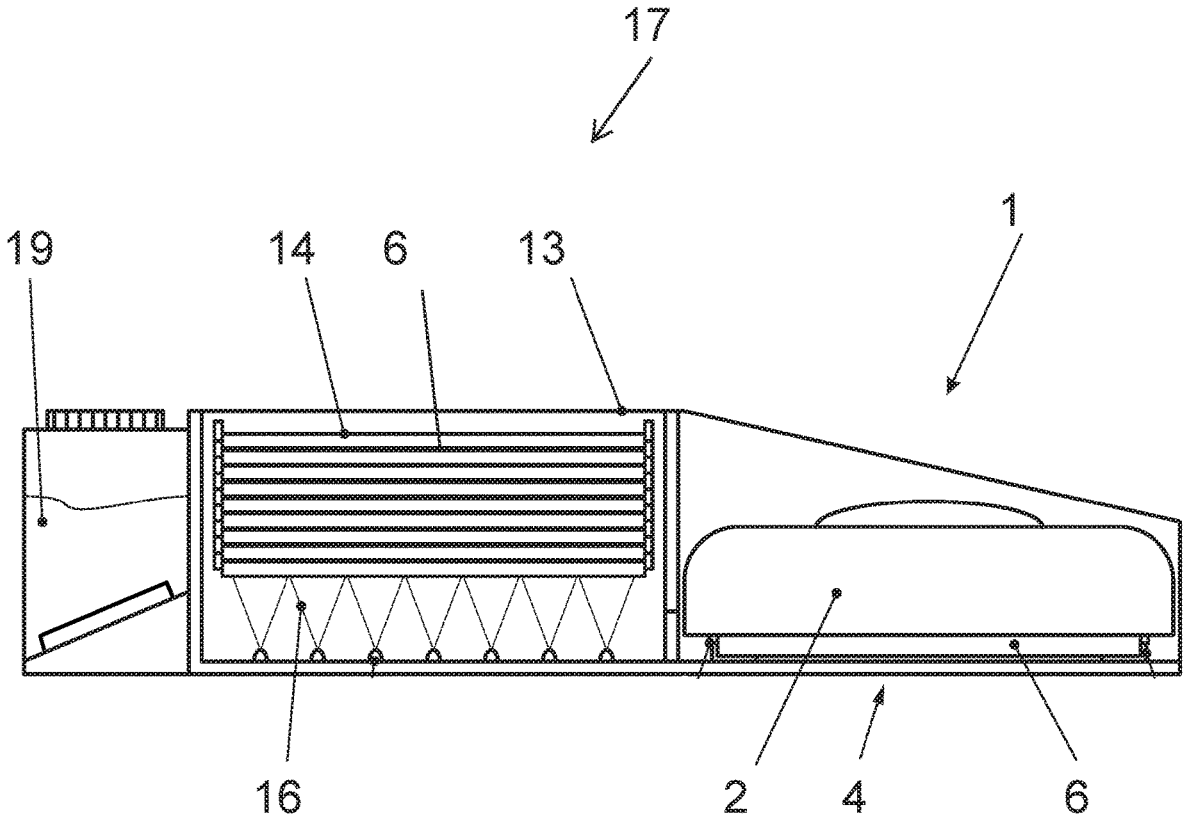
FIG. 8 illustrates a cleaning system with a pre-treatment device.

FIG. 8 shows an embodiment of the previously described cleaning system 17. In an embodiment, the base station 13 is equipped with a pre-treatment device 16 for the pre-treatment of mop pads 6. The pre-treatment device 16 is configured to apply a cleaning agent adapted to the upcoming cleaning task to a mop pad 6. In an embodiment, the pre-treatment device 16 comprises a spraying device which is designed to provide the mop pads 6 arranged in the first magazine 14 with a cleaning agent. Here the mop pad which is being sent to the receptacle unit 5 of the cleaning robot 1 is in each case pre-treated. The cleaning agent is accordingly applied directly before the sending to the receptacle unit 5. The pre-treatment device 16 comprises a reservoir 19 in which cleaning agent is arranged.

Figure 9:
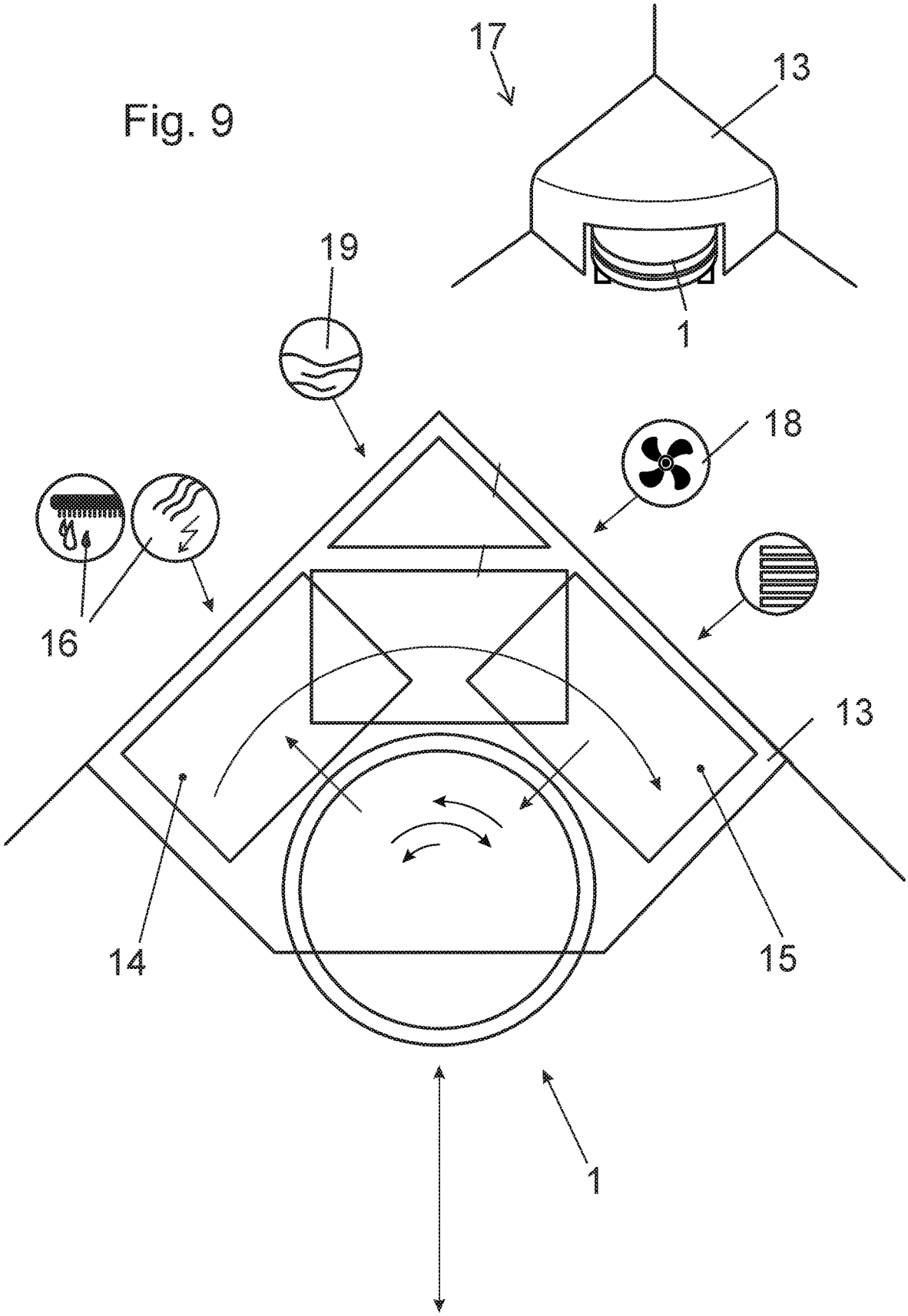
FIG. 9 illustrates a cleaning system with a pre-treatment device and a post-treatment device.

FIG. 9 shows a further embodiment of the cleaning system 17. In an embodiment, the base station 13 is equipped with a first magazine 14 for holding unused mop pads 6 and a second magazine 15 for holding used mop pads 6. Furthermore, the base station 13 has a pre-treatment device 16 for the pre-treatment of mop pads 6 which are arranged in the first magazine 14. Furthermore, the base station 13 has a post-treatment device 18 for the post-treatment of mop pads 6, which are located in the second magazine 15. The post-treatment device 18 is designed as a drying device and has a blower for this purpose.

While subject matter of the present disclosure has been illustrated and described in detail in the drawings and foregoing description, such illustration and description are to be considered illustrative or exemplary and not restrictive. Any statement made herein characterizing the invention is also to be considered illustrative or exemplary and not restrictive as the invention is defined by the claims. It will be understood that changes and modifications may be made, by those of ordinary skill in the art, within the scope of the following claims, which may include any combination of features from different embodiments described above.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A cleaning robot comprising:

a main body;

a drive device; and a cleaning device equipped for wet-cleaning floors to be cleaned, wherein:

the main body, on the side facing the floor to be cleaned, is assigned a receptacle unit, a first mop pad configured for wet-cleaning is fastened to the receptacle unit, the cleaning robot is configured to autonomously exchange the first mop pad fastened to the receptacle unit for a second mop pad, the first mop pad and the receptacle unit each have a fastener for fastening the first mop pad to the receptacle unit, and the receptacle unit is configured to be retracted into the main body.

2. The cleaning robot according to claim 1, wherein the main body includes a first storage unit configured to store mop pads.

3. The cleaning robot according to claim 2, wherein the mop pads stored in the first storage unit are provided with a cleaning agent.

4. The cleaning robot according to claim 2, wherein the main body includes a second storage unit for storing used mop pads.

5. The cleaning robot according to claim 4, wherein the main body includes a transport device which transports mop pads from the first storage unit to the receptacle unit and/or from the receptacle unit to the second storage unit.

6. The cleaning robot according to claim 1, wherein the first and second mop pads are reusable.

7. The cleaning robot according to claim 1, wherein the first and second mop pads are disposable articles.

8. The cleaning robot according to claim 1, wherein the the first or second mop pad is equipped with communication means for communication with the cleaning robot.

9. The cleaning robot according to claim 1, wherein first mop pad is held in a form-fitting manner in the receptacle unit.

10. A cleaning system comprising a cleaning robot according to claim 1 and a base station, wherein the base station is equipped to accommodate a first magazine of mop pads.

11. The cleaning system according to claim 10, wherein the cleaning robot is configured to remove at least one mop pad from the first magazine and send the at least one mop pad to the receptacle unit and/or to the second storage unit.

12. The cleaning system according to claim 10, wherein the base station comprises a second magazine for receiving used mop pads.

13. The cleaning system according to claim 10, wherein the base station has a pre-treatment device for pre-treating mop pads.

14. The cleaning system according to claim 13, wherein the pre-treatment device is configured to apply a cleaning agent, adapted to an upcoming cleaning task to the mop pads arranged in the first storage unit or to the mop pads arranged in the first magazine.

15. The cleaning system according to claim 13, wherein the pre-treatment device comprises a spraying device.

16. The cleaning system according to claim 10, wherein the base station has a post-treatment device for post-treating the mop pads.

* * * * *